US006392602B2

(12) United States Patent
Kawahata et al.

(10) Patent No.: US 6,392,602 B2
(45) Date of Patent: May 21, 2002

(54) CIRCULARLY POLARIZED WAVE ANTENNA AND DEVICE USING THE SAME

(75) Inventors: Kazunari Kawahata, Machida; Shigekazu Ito; Atsuyuki Yuasa, both of Sagamihara; Hisahi Akiyama, Yokohama, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/821,645

(22) Filed: Mar. 29, 2001

(30) Foreign Application Priority Data

Mar. 30, 2000 (JP) ..... 2000-094051

(51) Int. Cl.[7] ..... H01Q 1/38
(52) U.S. Cl. ..... 343/700 MS; 343/702
(58) Field of Search ..... 343/700 MS, 702, 343/850, 853; 455/90

(56) References Cited

U.S. PATENT DOCUMENTS 5,243,353 A * 9/1993 Nakahara et al. .... 343/700 MS
5,410,322 A * 4/1995 Sonoda ..... 343/700 MS
5,633,646 A * 5/1997 Strickland ..... 343/700 MS
6,040,806 A * 3/2000 Kushihi et al. ..... 343/853
6,147,647 A * 11/2000 Tassoudji et al. .... 343/700 MS
6,262,683 B1 * 7/2001 Kawahata et al. ... 343/700 MS

* cited by examiner

*Primary Examiner*—Don Wong
*Assistant Examiner*—James Clinger
(74) *Attorney, Agent, or Firm*—Ostrolenk, Faber, Gerb & Soffen, LLP

(57) ABSTRACT

A radiation electrode is formed on the upper face of the substantially columnar dielectric substrate. Feed electrodes for a fundamental mode and for a higher mode are formed on the side peripheral face of the dielectric substrate. Power is supplied through the respective feed electrodes to the radiation electrode via capacitive coupling. The radiation electrode has both of the functions in the fundamental and higher modes. Thus, the circular polarized wave antenna can be reduced in size. Furthermore, since a capacitive feeding system is employed as described above, the respective resonance frequencies in the fundamental and higher modes can be easily adjusted and set at predetermined frequencies. Also, the circularly polarized wave characteristics in the fundamental and higher modes can be easily enhanced, respectively.

12 Claims, 6 Drawing Sheets

CIRCULARLY POLARIZED WAVE ANTENNA AND DEVICE USING THE SAME

BACKGROUND OF THE INVENTION

1. Field of the Invention

The present invention relates to a circularly polarized wave antenna for transmitting—receiving a circularly polarized radio wave, and a communication device using the same.

2. Description of the Related Art

FIG. 6A is a schematic perspective view of a circularly polarized wave antenna contained in a radio wave device. FIG. 6B is a cross sectional view of a part taken along line a—a in FIG. 6A. The circularly polarized wave antenna 30 shown in FIGS. 6A and 6B is a circularly polarized wave micro-strip antenna described in Japanese Examined Patent Application Publication No. 7-46762. With the circularly polarized wave antenna 30, transmission—reception of radio waves in plural different frequency bands is realized. The circularly polarized wave antenna 30 can correspond to plural different systems such as GPS (Global Positioning System) and S-DAB (DAB(Digital Audio Broadcast) using an S band), and so forth.

The circularly polarized wave antenna 30 has the double structure in which MSA (micro-strip antenna) 32 for exciting a fundamental mode (principal mode) is loaded on the upper face of MSA 31 for exciting a higher mode, as shown in FIGS. 6A and 6B, in close contact with and coaxially with the MSA 32.

The higher mode excitation MSA 31 has the configuration in which a circular radiation electrode 34 is formed on the surface of a rectangular parallelepiped dielectric substrate 33. Feed pins (probes for a higher mode) G1, G1', G2, and G2' for feeding power to the radiation electrode 34 are inserted into the dielectric substrate 33. The fundamental mode of excitation of MSA 32 comprises a circular radiation electrode 38 formed on the upper face of the columnar dielectric substrate 37. Feed pins (fundamental mode probes) F1 and F2 for feeding power to the radiation electrode 38 are inserted so as to extend through the substrate.

By externally supplying power to the feed pins F1 and F2, the radiation electrode 38 is excited, so that transmission-reception of a circularly polarized radio wave in the fundamental mode can be carried out. When powers are externally supplied to the feed pins G1, G1', G2, and G2', respectively, in such a manner that powers in phase with each other are supplied to the feed pins G1 and G1', and the feed pins G2 and G2', and powers with a 90° phase shift are supplied to the feed pins G1 and G2, the radiation electrode 34 is excited, and thus, transmission-reception of the circularly polarized radio wave in the higher mode can be carried out.

In this patent specification, the fundamental mode is defined as a mode having the lowest resonance frequency in plural set excitation (resonance) modes, and the higher mode is defined as a mode having a resonance frequency higher than the lowest resonance frequency. Reference numeral 40 in FIGS. 6A and 6B designates a center pin for compensating for the symmetry of the fundamental and higher modes.

With the circularly polarized wave antenna 30 configured as described above, transmission—reception of radio waves in plural different frequency bands can be carried out. On the other hand, there arise the problems that the size of the antenna is increased, since the dielectric substrate 37 is overlaid on the dielectric substrate 33 so as to form plural steps. Furthermore, the circularly polarized wave antenna 30 has a configuration in which power is directed to the radiation electrode by use of the feed pins. With this configuration, problematically, the structure of the antenna 30 becomes complicated. Furthermore, problematically, it is difficult to adjust and set the interval between the respective resonance frequencies in the fundamental and higher modes.

Furthermore, the circularly polarized wave antenna 30 has the following problems. The circuit substrate onto which the circularly polarized wave antenna 30 is mounted is provided with a circuit for driving the circularly polarized wave antenna 30. In some cases, for the purpose of reducing size, the circuit is formed on the back face opposite to the surface having the antenna mounted thereto. In the circularly polarized wave antenna 30, the feed pins are disposed near to the center of the dielectric substrate 31. Accordingly, in the case of the circuit provided on the back face of the circuit substrate as described above, it is difficult to electrically connect the feed pins and the circuit to each other sufficiently, and moreover, there is the problem that patterning the circuit is difficult.

SUMMARY OF THE INVENTION

To solve the above problems, the present invention has been devised. It is an object of the present invention to provide a circularly polarized wave antenna which realizes transmission—reception of circularly polarized radio waves in both fundamental and higher modes, and is small in size, and with which a good circularly polarized wave characteristic can be easily obtained, and to provide a communication device using the same. It is another object of the present invention to provide a circularly polarized wave antenna in which the interval between the respective resonance frequencies in the fundamental and higher modes can be easily adjusted and set, and a communication device using the same.

To achieve the above and other objects, according to the present invention, there is provided a circularly polarized wave antenna which comprises a substantially circular dielectric substrate, a radiation electrode for transmitting—receiving a circularly polarized radio wave formed on the upper face of the dielectric substrate, a fundamental mode feed electrode for feeding power to the radiation electrode to excite the radiation electrode in a fundamental mode, and a higher mode feed electrode for feeding power to the radiation electrode to excite the radiation electrode in a higher mode, the fundamental and higher mode feed electrodes being formed on the side peripheral face of the dielectric substrate and being configured so as to feed the powers to the radiation electrode via capacitive coupling.

Preferably, the radiation electrode is substantially circular, and is provided on the upper face of the dielectric substrate with the center of the radiation electrode being positioned substantially on the center axis of the dielectric substrate. Also preferably, the radiation electrode has such a form as to carry out degeneracy-separation.

Preferably, the radiation electrode is substantially a ring-shape, and is provided on the upper face of the dielectric substrate with the center of the ring of the radiation electrode being positioned substantially on the center axis of the dielectric substrate, and the non-electrode portion enclosed by the ring-shaped radiation electrode comprises a frequency setting portion for adjusting and setting the interval between the respective resonance frequencies in the fundamental and higher modes.

More preferably, a concavity or through-hole is formed in the non-electrode portion enclosed by the substantially ring-shaped radiation electrode in the dielectric substrate.

According to the present invention, there is provided a communication device which includes the circularly polarized wave antenna described above.

According to the present invention having the above-described constitution, when power is supplied from the fundamental mode feed electrode formed on the side peripheral face of the substantially columnar dielectric substrate to the radiation electrode formed on the upper face of the dielectric substrate via capacitive coupling, the radiation electrode is excited in the fundamental mode, so that transmission—reception of a circularly polarized radio wave in the fundamental mode can be carried out. Moreover, when power is supplied from the higher mode feed electrode to the radiation electrode via capacitive coupling, the radiation electrode is excited in the higher mode, so that transmission—reception of the circularly polarized radio wave in the higher mode can be carried out.

The radiation electrode has both of the functions as a radiation electrode for the fundamental mode and as a radiation electrode for the higher mode. Accordingly, in contrast to the case in which the radiation electrodes for the fundamental mode and the higher mode are separately provided, the size of the antenna can be prevented from increasing or can be reduced in size.

Furthermore, the circularly polarized wave antenna of the present invention is configured so that power is supplied from the feed electrodes to the radiation electrode via capacitive coupling. Accordingly, a good circularly polarized wave characteristic can be obtained in each of the fundamental and higher modes, in contrast to the case of the direct feeding using the feed pins.

Moreover, in the case in which the radiation electrode has a substantially ring shape, the non-electrode portion enclosed by the radiation electrode is provided, and the concavity or through-hole is formed in the non-electrode portion in the dielectric substrate, the interval between the respective resonance frequencies in the fundamental and higher modes can be easily adjusted and set by changing the size of the non-electrode portion and the sizes of the concavity or through-hole. Thus, the adjustment and setting of the interval between the respective resonance frequencies in the fundamental and higher modes can be simply achieved, and can be set at a predetermined interval specified by specifications or the like.

BRIEF DESCRIPTION OF THE DRAWING(S)

DETAILED DESCRIPTION OF EMBODIMENTS OF THE INVENTION

Hereinafter, embodiments of the present invention will be described with reference to the drawings.

Figure 1A:
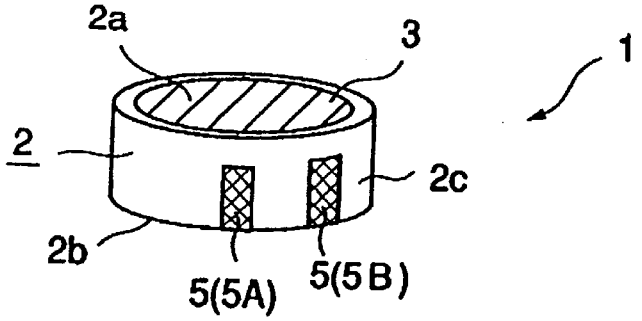
FIGS. 1A and 1B illustrate a circularly polarized wave antenna according to a first embodiment of the present invention.

FIG. 1A is a perspective view schematically showing a circularly polarized wave antenna according to a first embodiment of the present invention. Moreover, FIG. 1B shows plan views of the circular polarized wave antenna of the above FIG. 1A, taken in the six directions, that is, taken from the upper, under, right, left, front, and back sides thereof, respectively.

Figure 1B:
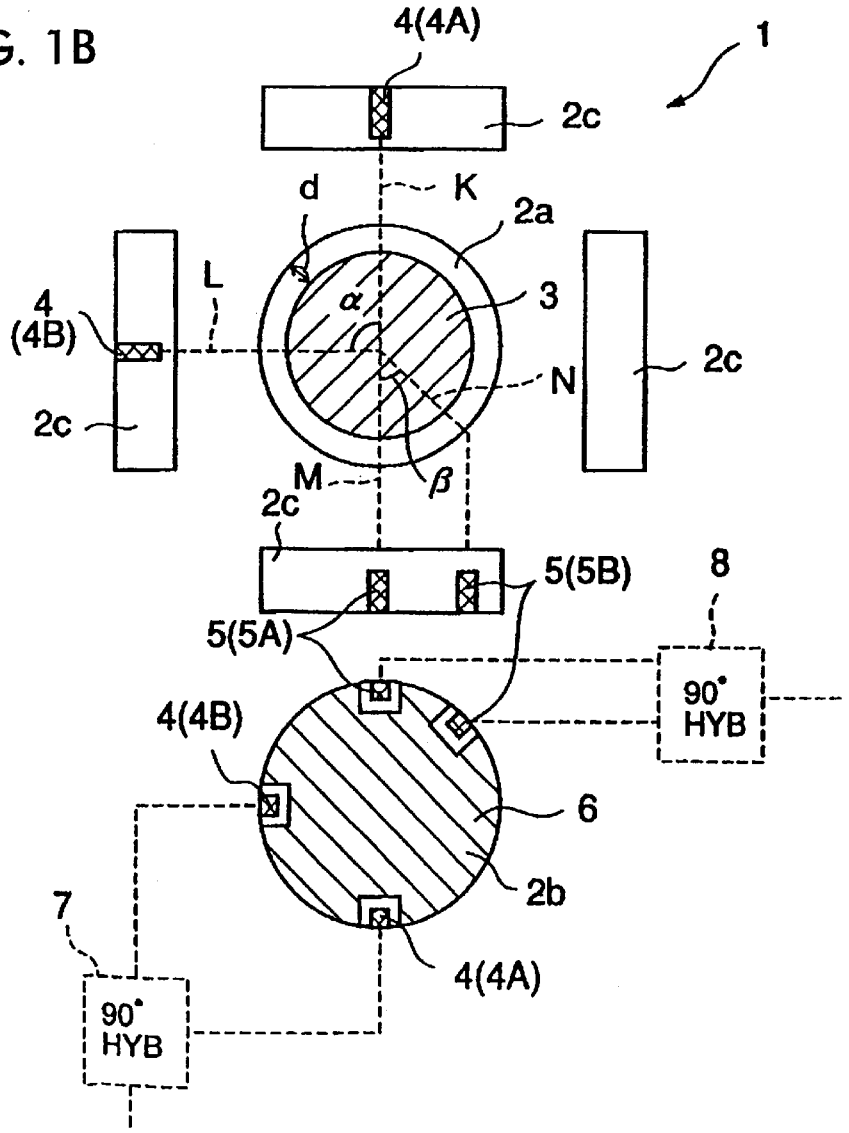

As shown in FIGS. 1A and 1B, the circular polarized wave antenna 1 contains a columnar dielectric substrate 2. A circular radiation electrode 3 is formed on the upper face 2*a* of the dielectric substrate 2. The radiation electrode 3 is formed on the upper face 2*a* in such a manner that the center of the radiation electrode 3 is positioned on the center axis of the dielectric substrate 2. The distance d between the outer edge of the upper face 2*a* of the dielectric substrate 2 and the edge of the radiation electrode 3 is substantially constant with respect to the whole peripheral edge of the dielectric substrate 2.

On the side peripheral face 2*c* of the dielectric substrate 2, band-shaped feed electrodes 4A and 4B for a fundamental mode and feed electrodes 5A and 5B for a higher mode are formed so as to extend from the under-face 2*b* side toward the upper face 2*a* side. The upper ends of these feed electrodes 4A, 4B, 5A, and 5B are positioned at an interval from the radiation electrode 3, and the lower end sides thereof are bent onto the under face 2*b* of the dielectric substrate 2. A ground electrode 6 is formed substantially on the whole of the under face 2*b* of the dielectric substrate 2, so as to be distant from the lower ends of the above respective feed electrodes 4A, 4B, SA, and 5B, respectively. In the example shown in FIGS. 1A and 1B, the angle a connecting the above fundamental mode feed electrode 4A and the center axis of the dielectric substrate 2 to the straight line L connecting the fundamental mode feed electrode 4B and the center axis of the dielectric substrate 2 is substantially 90°. Moreover, the angle β of the straight line M connecting the higher mode feed electrode 5A and the center axis of the dielectric substrate 2 to the straight line N connecting the higher mode feed electrode 5B and the center axis of the dielectric substrate 2 is substantially 45°. Moreover, the above fundamental mode feed electrode 4A and the higher mode feed electrode 5A are arranged in opposition to each other via the center axis of the dielectric substrate 2.

In the example shown in FIG. 1B, the higher mode feed electrode 5B is arranged on the right side of the higher mode feed electrode 5A. However, the arrangement and position of the feed electrode 5B with respect to the higher mode feed electrode 5A is appropriately set, correspondingly to the conditions such as the rotation direction of a circularly polarized wave or the like, predetermined, e.g., by specifications or the like. For example, the feed electrode 5B may be disposed on the left side of the higher mode feed electrode 5A. Also in this case, the angle β of the straight line connecting the higher mode feed electrode 5A and the center axis of the dielectric substrate 2 to the straight line connecting the higher mode feed electrode 5B and the center axis of the dielectric substrate 2 is set substantially at 45°. Moreover, regarding the fundamental mode feed electrodes 4A and 4B, similarly, the arrangement and position of the fundamental mode feed electrode 4B with respect to the fundamental mode feed electrode 4A is appropriately set, correspondingly to the conditions such as the rotation direction of a circularly polarized wave and so forth predetermined, e.g., by specifications or the like.

The circular polarized wave antenna I of the first embodiment is configured as described above. The above-described dielectric substrate 2 is mounted onto a circuit substrate with the under face 2*b* being used as a mounting surface. In the circuit substrate, a 90° hybrid circuit (90° HYB) 7 for a fundamental mode, and a 90° hybrid circuit (90° HYB) 8 for a higher mode are formed, as indicated by dotted lines in FIG. 1B. When the circular polarized wave antenna 1 is mounted in a predetermined position on the above circuit substrate, the fundamental mode feed electrodes 4A and 4B are electrically connected to the above-described fundamental 90° hybrid circuit 7, respectively. The higher mode feed electrodes 5A and 5B are electrically connected to the higher mode 90° hybrid circuit 8.

The fundamental mode 90° hybrid circuit 7 is connected, e.g., to a GPS system (not shown) using a circularly polarized wave in the fundamental mode. The higher mode 90° hybrid means 8 is connected, e.g., to an S-DAB system (not shown) using a higher mode circularly polarized radio wave.

When the circular polarized wave antenna 1 is mounted to the circuit substrate as described above, and powers with a phase difference of 90° are supplied to the fundamental mode feed electrodes 4A and 4B via the fundamental mode 90° hybrid circuit 7, respectively, the respective fundamental mode feed electrodes 4A and 4B transmits the supplied powers to the radiation electrode 3 via capacitive coupling. Similarly, when powers with a phase difference of 90° are supplied to the higher mode feed electrodes 5A and 5B via the higher mode 90° circuit means 8, the higher mode feed electrodes 5A and 5B transmit the supplied powers to the radiation electrode 3 via capacitive coupling, respectively.

As described above, when the power is fed from the fundamental mode feed electrodes 4A and 4B to the radiation electrode 3 via the capacitive coupling, the radiation electrode 3 is excited in the fundamental mode to carry out the transmission—reception of the circularly polarized radio wave. On the other hand, when the power is fed from the higher mode feed electrodes 5A and 5B to the radiation electrode 3, the radiation electrode 3 is excited in the higher mode to carry out the transmission—reception of the circularly polarized radio wave.

In the first embodiment, the fundamental mode feed electrodes 4A and 4B and the higher mode feed electrodes 5A and 5B are formed on the side peripheral face 2*c* of the dielectric substrate 2. Powers are supplied from the fundamental mode feed electrodes 4A and 4B to the radiation electrode 3 via capacitive coupling, whereby the radiation electrode 3 is excited in the fundamental mode and carries out transmission—reception of a circularly polarized radio wave. On the other hand, powers are supplied from the higher mode feed electrodes 5A and 5B to the radiation electrode 3 via capacitive coupling, whereby the radiation electrode 3 is excited in the higher mode and carries out transmission—reception of a circularly polarized radio wave. In this configuration, the transmission—reception of circularly polarized radio waves in the two modes, that is, the fundamental and higher modes can be carried out by use of one radiation electrode 3. Thereby, the structure of the circularly polarized wave antenna can be simplified. Moreover, the circular polarized wave antenna 1 can be reduced in size in contrast to the case in which radiation electrodes for fundamental and higher modes are separately provided.

Furthermore, conventionally, power is supplied to a radiation electrode by direct feeding utilizing a feed pin. Therefore, there arises the problem that the respective resonance frequencies in the fundamental and higher modes are adjusted and set with difficulty. On the other hand, in the first embodiment, the fundamental and higher mode feed electrodes 4A, 4B, 5A, and 5B are provided on the side peripheral face 2*c* of the dielectric substrate 2, whereby powers are supplied from the feed electrodes 4A, 4B, 5A, and 5B to the radiation electrode 3. Thus, the respective resonance frequencies in the fundamental and higher modes can be easily adjusted and set.

Furthermore, in the first embodiment, the feed electrodes 4A, 4B, 5A, and 5B for fundamental and higher modes are formed on the side peripheral face 2*c* of the dielectric substrate 2, in contrast to the conventional case in which the feed pins are formed in the center of the dielectric substrate 2. Accordingly, electrical connection of the fundamental mode 90° hybrid circuit 7 to the fundamental mode feed electrodes 4A and 4B, and moreover, electrical connection of the higher mode 90° hybrid circuit 8 to the higher mode feed electrodes 5A and 5B can be easily achieved. Furthermore, patterning for a circuit containing the 90° hybrid circuits 7 and 8 can be simplified.

Figure 2:
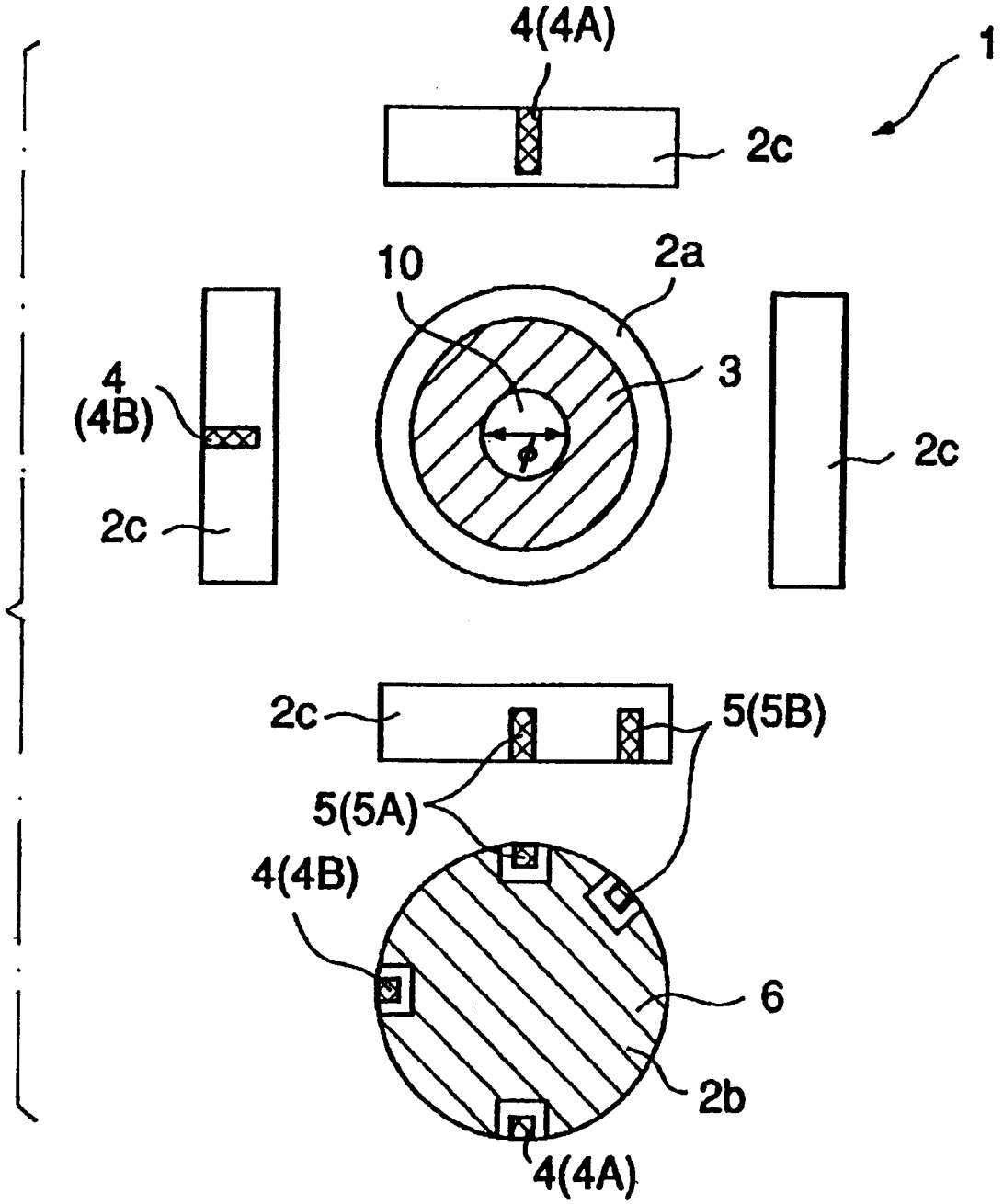
FIG. 2 illustrates a circularly polarized wave antenna according to a second embodiment of the present invention.

Hereinafter, a second embodiment of the present invention will be described. Characteristically in the second embodiment, as shown in FIG. 2, the radiation electrode 3 has a ring shape, and a circular non-electrode portion 10 enclosed by the radiation electrode 3 is provided. The other configuration is the same as that of the above-described first embodiment. In the description of the second embodiment, the similar parts to those in the first embodiment are designated by the same reference numerals. The repeated description of the parts are omitted.

In the second embodiment, the ring-shaped radiation electrode 3 is provided with the center of the ring being positioned on the center axis of the dielectric substrate 2.

The circularly polarized wave antenna 1 of the second embodiment has the same configuration as that of the first embodiment. Thus, needless to say, the antenna 1 of the second embodiment has great advantages comparable to those of the first embodiment. Moreover, in the second embodiment, the radiation electrode 3 is formed in a ring-shape so as to form the non-electrode portion 10. Thus, there are the advantages that adjustment and setting of the interval between the respective resonance frequencies in the fundamental and higher modes can be easily carried out. The reason is as follows. There are differences between the current conduction routes and the current distributions of the fundamental and higher modes in the radiation electrode 3. Owing to these differences, the change amount of the resonance frequency in the fundamental mode based on the change ratio of the size of the non-electrode portion 10 becomes different from that of the resonance frequency in the higher mode. Accordingly, the interval between the resonance frequencies in the fundamental and higher modes can be varied for setting, correspondingly to the size of the non-electrode portion 10.

Concretely, with the size (diameter $\phi$) of the non-electrode portion 10 being increased, the respective resonance frequencies in the fundamental and higher modes are shifted more to the low frequency side. The change amount of the resonance frequency in the fundamental mode is larger than that of the resonance frequency in the higher mode. The larger the change amount of the size of the non-electrode portion 10 the more the resonance frequency in the fundamental mode is shifted to the low frequency side than the resonance frequency in the higher mode. Thus, the interval between the respective resonance frequencies in the fundamental and higher modes can be increased.

As seen in the above-description, by appropriately setting the size (diameter $\phi$) of the non-electrode portion 10, the interval between the respective resonance frequencies in the fundamental and higher modes can be adjusted and set to a desired interval specified by specifications or the like. Thus, since the interval between the respective resonance frequencies in the fundamental and higher modes can be adjusted and set by adjustment and setting of the size of the non-electrode portion 10, it can be adjusted and set without the design being significantly changed. For example, the circularly polarized wave antenna of the present invention can cope, quickly and without any trouble, with changes in the specifications of the fundamental or higher mode resonance frequency and so forth, if they occur. Thereby, the cost of the circular polarized wave antenna 1 can be reduced.

Hereinafter, a third embodiment will be described. In description of the third embodiment, similar parts to those in the above second embodiment are designated by the same reference numerals. The repeated description of the parts are omitted.

Figure 3A:
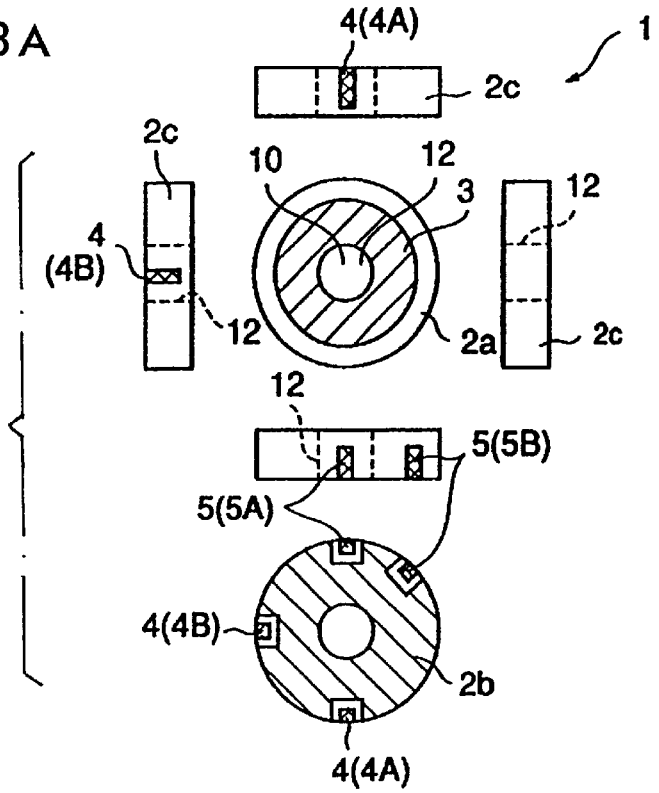
FIGS. 3A and 3B illustrate a circularly polarized wave antenna according to a third embodiment of the present invention.
Figure 3B:
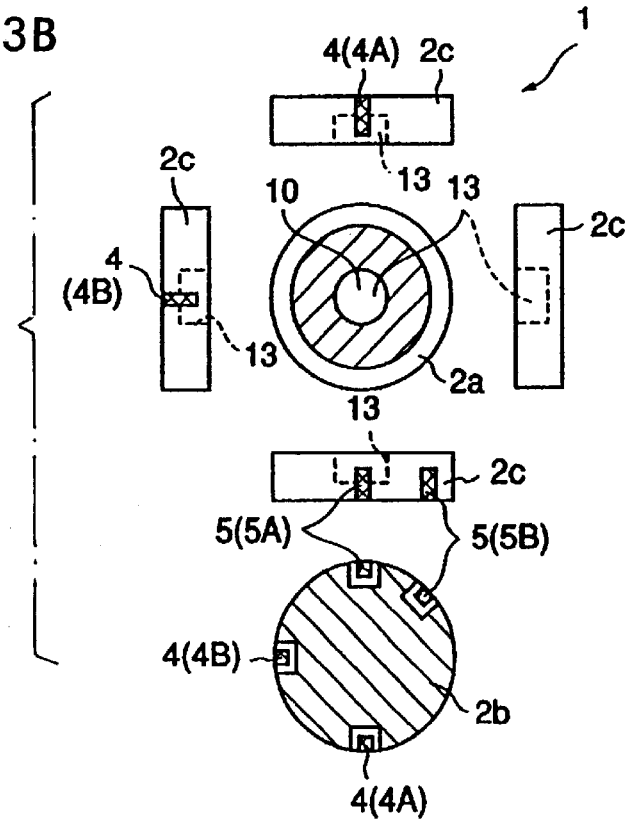
Figure 4:
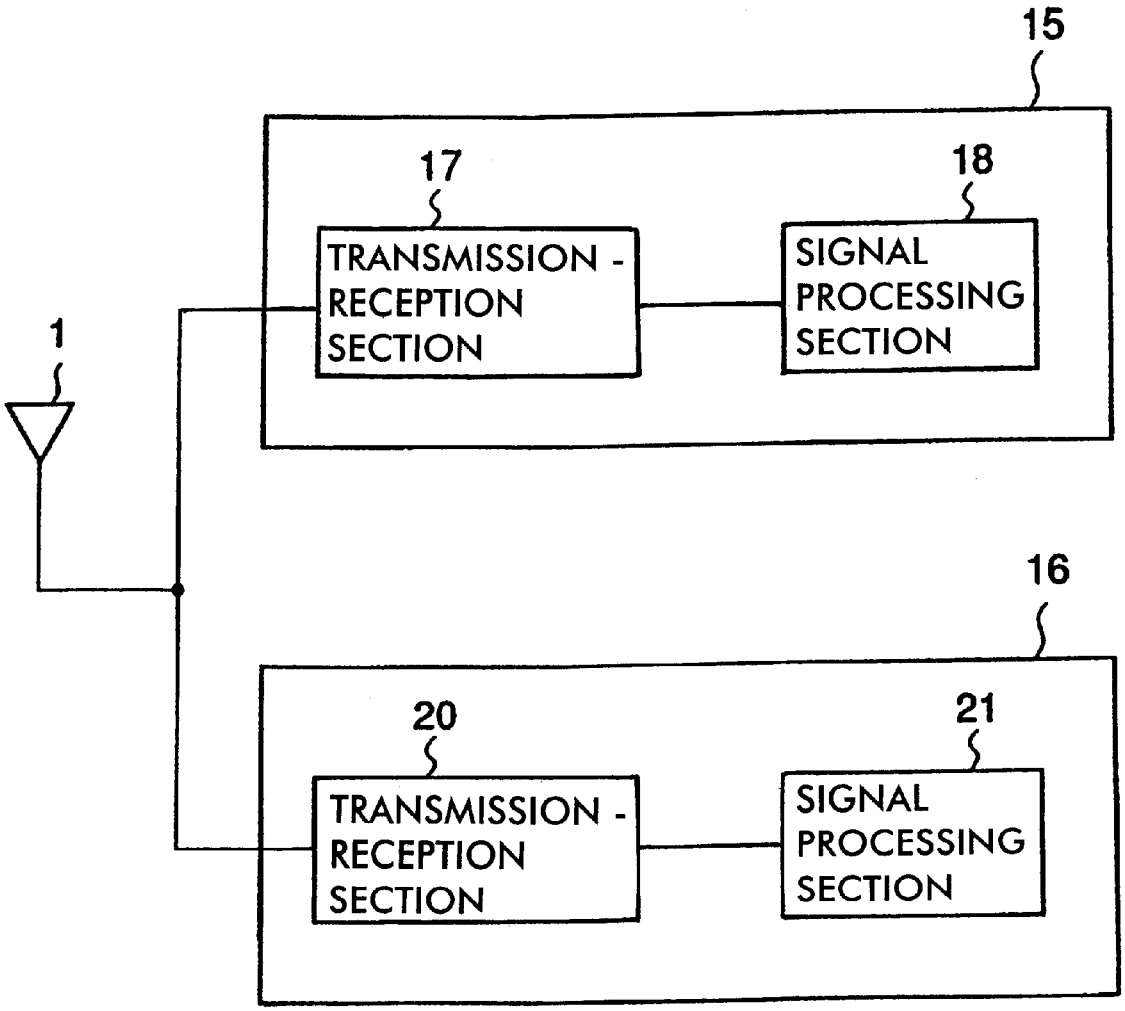
FIG. 4 illustrates a communication device according to an embodiment of the present invention.

The third embodiment, though it has nearly the same constitution as that of the second embodiment, is characteristically different from the second embodiment in that a through-hole 12 is formed in the non-electrode portion 10 of the dielectric substrate 2 as shown in FIG. 3A, or a concavity 13 is formed in the non-electrode portion 10 of the dielectric substrate 2, as shown in FIG. 3B.

In the third embodiment, as shown in FIG. 3A or 3B, the cross-section of the dielectric substrate 2, taken along a plane parallel to the upper face 2*a* has the same circular shape as the non-electrode portion 10, the center of the circular cross-section of the through-hole 12 or the concavity 13 is positioned on the central axis of the dielectric substrate 2, the size of the circular cross-section of the through-hole 12 or the concavity 13 is the same as that of the circular non-electrode portion 10, and the edge of the through-hole 12 or the concavity 13 substantially overlaps with the edge of the non-electrode portion 10.

In the third embodiment, since the radiation electrode 3 is formed in a ring-shape so as to produce the non-electrode portion 10, which is enclosed by the radiation electrode 3 similarly to the second embodiment, the interval between the respective resonance frequencies in the fundamental and higher modes can be easily adjusted and set by adjustment and setting of the size of the non-electrode portion 10.

Especially, in the third embodiment, since the through-hole 12 or the concavity 13 is provided in the non-electrode portion 10 of the dielectric substrate 2, the interval between the respective resonance frequencies in the fundamental and higher modes can be adjusted and set also by changing the diameter and the depth of the through-hole 12 or the concavity 13. Accordingly, the interval between the respective resonance frequencies in the fundamental and higher modes can be adjusted and set by adjustment and setting of the size of the non-electrode portion 10 and also by adjustment and setting of the size of the through-hole 12 or the concavity 13. That is, the range in which the interval between the respective resonance frequencies in the fundamental and higher modes can be increased, and moreover, the interval between the respective resonance frequencies in the fundamental and higher modes can be adjusted and set more accurately.

Furthermore, since the through-hole 12 or the concavity 13 is provided, the weight of the dielectric substrate 2 is reduced. Accordingly, the weight of the circular polarized wave antenna 1 can be decreased.

Hereinafter, a fourth embodiment will be described. The fourth embodiment shows an example of a communication device having the circularly polarized wave antenna mounted thereto. The communication device shown in the fourth embodiment comprises a circularly polarized wave antenna 1, a first system portion 15, and a second system portion 16. The first system portion 15 comprises a transmission—reception section 17 and a signal processing section 18. The second system portion 16 comprises a transmission—reception section 20 and a signal processing section 21.

In the fourth embodiment, characteristically, as the circularly polarized wave antenna 1, one of the circularly polarized wave antennas I described in the above embodiments is mounted. In this fourth embodiment, description of the circularly polarized wave antenna 1 mounted in the communication device, which has been already made in the above embodiments, is omitted.

The first system portion 15 utilizes a circularly polarized radio wave in a fundamental mode, and constitutes a GPS system, for example. The second system portion 16 utilizes a circularly polarized radio wave in a higher mode, and constitutes an S-DAB system, for example. In particular, to the transmission—reception section 17 of the first system portion 15, a reception signal is added, which is based on the circularly polarized radio wave in a fundamental mode, received via the circular polarized wave antenna 1. The transmission—reception section 17 provides predetermined various signals from the reception signal and sends the signals to the signal processing section 18. In the signal processing section 18, the signals are processed to control the operation of the communication device.

When a signal for external transmission is provided to the transmission—reception section 17 from the signal processing section 18, the transmission-reception section 17 converts the signal to a signal for transmission in the fundamental mode and supplies the converted signals to the circular polarized wave antenna 1. Thus, the circular polarized wave antenna 1 excites a circularly polarized wave in the fundamental mode to carry out transmission - reception of the circularly polarized wave.

A reception signal based on a radio wave in the higher mode frequency band, received by the circular polarized wave antenna 1, is provided to the transmission—reception section 20 in the second system portion 16. The transmission—reception section 20, similarly to the transmission—reception section 17 in the second system portion 16, provides predetermined various signals from the received signal and sends the signals to the signal processing section 21. The signal processing section 21 processes the signals to control the operation of the communication device. Moreover, when a signal for external transmission is provided from the signal processing section 21 to the transmission—reception section 20, the section 20 converts the signal to a higher mode signal for transmission and supplies to the converted signal to the circular polarized wave antenna 1. Thereby, the circular polarized wave antenna 1 carries out excitation in the higher mode to transmit the circularly polarized radio wave in the higher mode.

In the fourth embodiment, the circular polarized wave antenna 1 described in the above embodiments is mounted. Since the mounted circular polarized wave antenna 1 has a good circularly polarized wave characteristic, the reliability of the antenna characteristic of the communication device can be enhanced. Moreover, the respective resonance frequencies in the fundamental and higher mode are correctly set in compliance with specifications. Thus, communication can be made very stably, and the operation of the communication device becomes stable. Accordingly, the reliability of the performance of the communication device can be enhanced.

This invention is not limited to the above embodiments, and can take various forms. For example, the radiation electrode 3 is circular in the above embodiments. The radiation electrode 3 may have a substantially circular shape. For example, the radiation electrode 3 may have a polygonal shape such as an hexagonal or octagonal shape or the like, an elliptic shape, and so forth. The dielectric substrate 2 is columnar. The dielectric substrate 2 may be substantially columnar, and for example, may be a polygonal prism shape such as an hexagonal or octagonal prism shape, an elliptic columnar shape, or the like.

Figure 5:
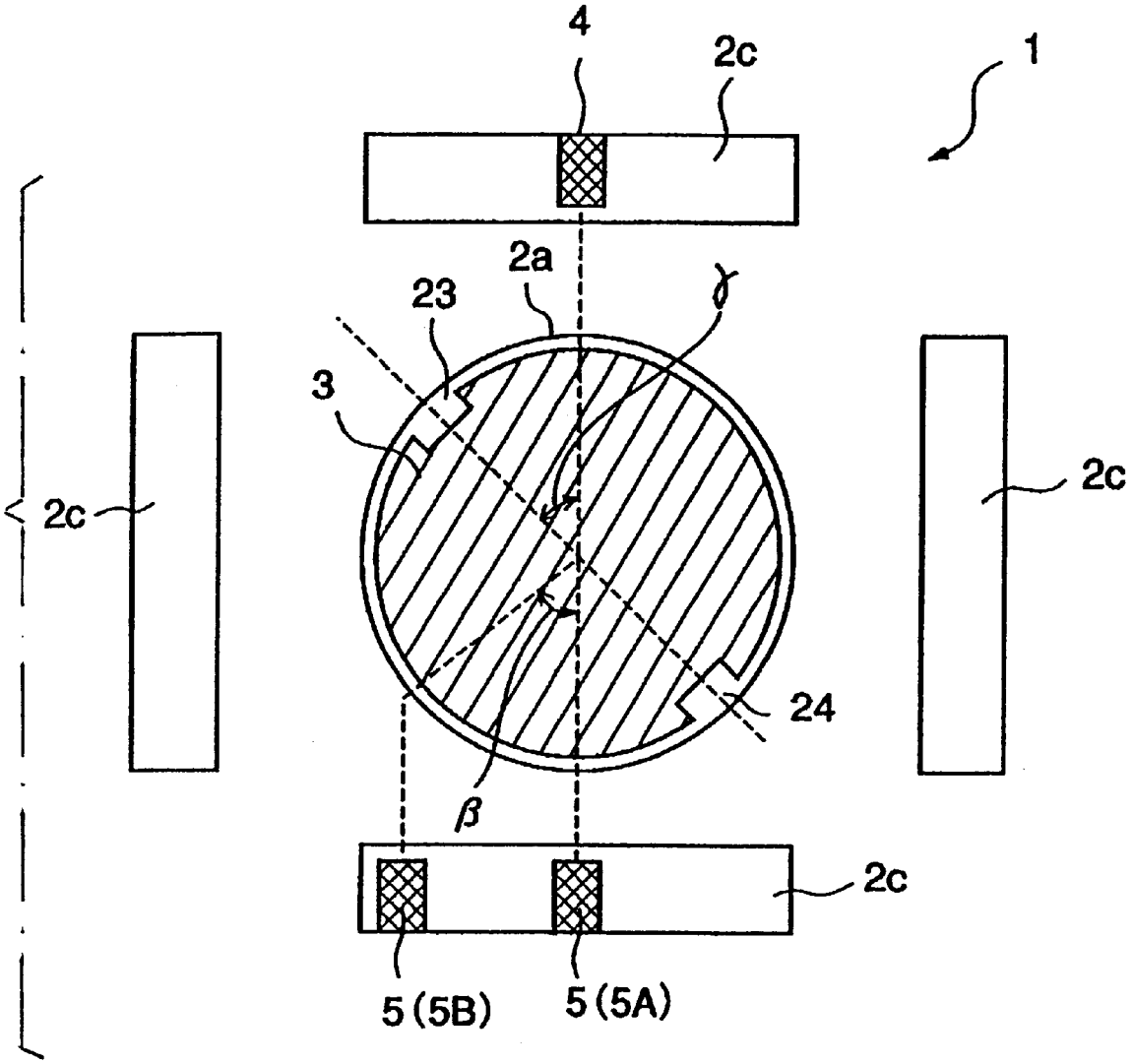
FIG. 5 illustrates a circularly polarized wave antenna according to another embodiment of the present invention.
Figure 6A:
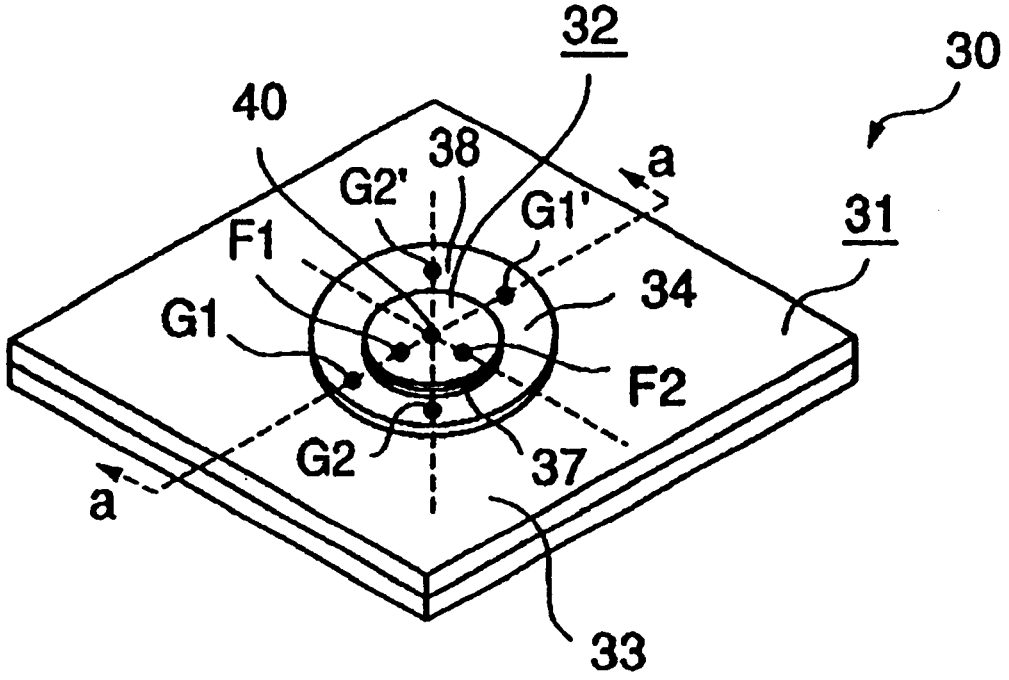
FIGS. 6A and 6B illustrate an example of a conventional circularly polarized wave antenna.
Figure 6B:
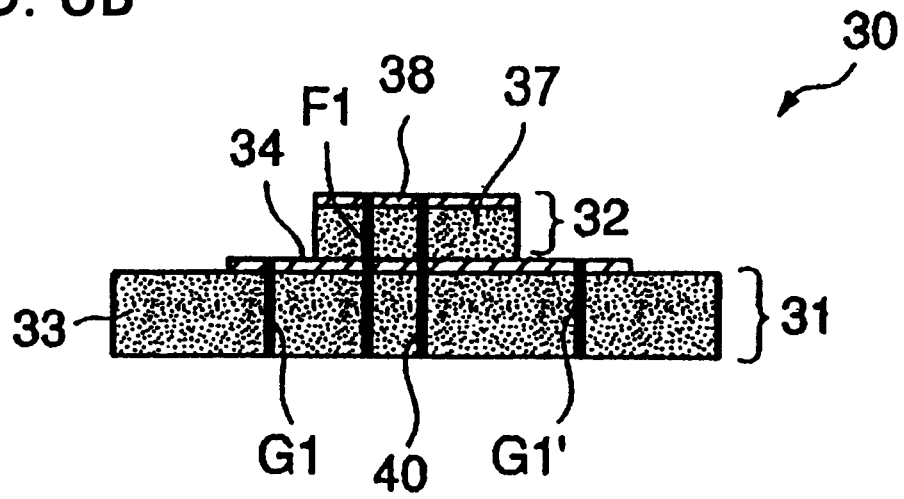

Furthermore, in the above embodiments, the radiation electrode 3 is substantially circular, and the two fundamental mode feed electrodes 4A and 4B are provided. For example, as shown in FIG. 5, the radiation electrode 3 may be provided with notches 23 and 24 so as to have such a shape in which the radiation electrode 3 can carry out the degeneracy and separation. Thus, as the fundamental mode feed electrode, only the feed electrode 4 may be provided. In the case in which the radiation electrode 3 has the shape in which the electrode 4 can carry out the degeneracy and separation as shown in FIG. 5, the higher mode feed electrodes 5A and 5B are provided as well as in the above embodiments.

In the example shown in FIG. 5, the notches 23 and 24 of the radiation electrode 3 are arranged in opposition to each other about the center axis of the dielectric substrate 2. The angle 8 between the straight line passing these notches 23 and 24 and the center axis of the dielectric substrate 2 and the straight line passing a fundamental mode feed electrode 4 and the center axis of the dielectric substrate 2 is substantially 45°. Moreover, the fundamental mode feed electrode 4 is arranged in opposition to the higher mode feed electrode 5A about the center axis of the dielectric substrate 2. Moreover, the angle β between feed electrode 5A and electrode 5B is substantially −45°.

Similarly to the above embodiments, the circular polarized wave antenna 1 shown in FIG. 5 has a configuration in which the fundamental mode feed electrode 4 and the higher mode feed electrodes 5A and 5B are formed on the side peripheral face 2*c* of the dielectric substrate 2, and power is supplied to the radiation electrode 3 via capacitive coupling. Similarly to the above embodiments, the circular polarized wave antenna 1 has the advantages that the circular polarized wave antenna 1 can be reduced in size, adjustment and setting of the respective resonance frequencies in the fundamental and higher modes can be easily performed, and so forth.

Furthermore, a non-electrode portion 10 as described in the second embodiment may be formed in the center of the radiation electrode 3 having such a degeneracy-separation shape as shown in FIG. 5. In this case, there are the advantages that the interval between the respective resonance frequencies in the fundamental and higher modes can be easily adjusted and set by adjustment of the size of the non-electrode portion 10, as well as in the second embodiment. Moreover, similarly to the third embodiment, a concavity or through-hole may be provided in the non-electrode portion 10 of the dielectric substrate 2. In this case, the interval between the respective resonance frequencies in the fundamental and higher modes can be adjusted and set more easily, and moreover, the weight of the circular polarized wave antenna 1 can be reduced.

The formation positions of the notches 23 and 24 in the radiation electrode 3, and those of the feed electrodes 4, 5A, and 5B are appropriately set correspondingly to the rotation direction of a circularly polarized wave, and so forth, specified by specifications or the like, not limited to the formation positions shown in FIG. 5.

Furthermore, in the above embodiments, the fundamental mode feed electrodes 4A and 4B, or 4 and the higher mode feed electrode 5A and 5B are formed on the side peripheral face 2*c* of the dielectric substrate 2, that is, on the curved face thereof. For example, the area in the side peripheral face 2*c* of the dielectric substrate 2 where the feed electrodes are formed may be a flat surface, on which the fundamental mode feed electrodes 4A and 4B, or 4 and the higher mode feed electrode 5A and 5B are formed. In this case, advantageously, the patterns of the feed electrodes 4A and 4B, or 4, and 5A and 5B can be easily formed.

Moreover, the fundamental mode feed electrodes 4A and 4B, or 4 and the higher mode feed electrodes 5A and 5B described in the above embodiments may be formed so that the upper sides thereof are further elongated and bent onto the upper face 2*a*. Needless to say, in this case, the antenna has the configuration in which the ends on the upper face 2*a* of the feed electrodes 4 and 5 are arranged at an interval from the radiation electrode 3, so that the feed electrodes 4A and 4B, or 4 and 5A and 5B can capacitively couple to the radiation electrode 3.

Moreover, in the second and third embodiments, the outer edge of the ring-shaped radiation electrode 3 and the inner edge thereof (the edge of the non-electrode portion 10) are circular. These edges may have a polygonal shape such as an hexagonal or octagonal shape or the like, or an elliptic shape.

In the above third embodiment, the diameter of the through-hole 12 or the concavity 13 is equal to the diameter of the non-electrode portion 10. The diameter may be smaller than that of the non-electrode portion 10, and is appropriately adjusted and set correspondingly to the predetermined resonance frequencies in the fundamental and higher modes.

According to the present invention, the circular polarized wave antenna has a constitution in which the radiation electrode having, e.g., a columnar shape or degeneracy-separation shape is formed on the upper face of the substantially columnar dielectric substrate, the fundamental mode feed electrode and the higher mode feed electrode are formed on the side peripheral face of the dielectric substrate, whereby powers are supplied through the fundamental and higher mode feed electrodes to the radiation electrode via capacitive coupling. Accordingly, the radiation electrodes, when receiving power through the fundamental mode feed electrodes, carry out the transmission—reception of the circularly polarized radio wave in the fundamental mode, and moreover, when receiving power through the higher mode feed electrodes, carry out the transmission—reception of the circularly polarized radio wave in the higher mode. Thus, the radiation electrode has both of the functions as a radiation electrode for a fundamental mode and also as a radiation electrode for a higher mode. The structure of the circularly polarized wave antenna can be simplified. Accordingly, the structure of the circularly polarized wave antenna can be reduced in size, in contrast to the case in which the fundamental and higher mode feed electrodes are separately provided.

The present invention employs a capacitive feeding system in which power is supplied in the fundamental or higher mode to the radiation electrode through the feed electrodes formed on the side peripheral face of the dielectric substrate. Thus, the respective resonance frequencies in the fundamental and higher modes can be accurately set at predetermined frequencies. Moreover, a good circularly polarized wave characteristic can be easily obtained for both of the fundamental and higher modes.

Furthermore, as described above, the fundamental and higher mode feed electrodes are formed on the side peripheral face of the dielectric substrate. Accordingly, the feed electrodes can be easily formed, and moreover, the respective feed electrodes can be easily electrically connected to the circuit for driving the antenna.

When the radiation electrode has a substantially ring-shape, and the nonelectrode portion enclosed by this radiation electrode is formed, the interval between the respective resonance frequencies in the fundamental and higher modes can be varied by changing the size of the non-electrode portion. Accordingly, the interval between the respective resonance frequencies in the fundamental and higher modes can be adjusted and set at a predetermined interval by adjustment of the size of the non-electrode portion. Thus, adjustment and setting of the interval between the respective resonance frequencies in the fundamental and higher modes can be easily performed.

When the concavity or through-hole is formed in the non-electrode portion of the dielectric substrate, the interval between the respective resonance frequencies in the fundamental and higher modes can be varied by changing the size of the non-electrode portion. Therefore, the interval between the respective resonance frequencies in the fundamental and higher modes can be adjusted and set at a predetermined interval by adjusting the size of the non-electrode portion and also by adjusting the size of the concavity or through-hole. Thus, adjustment and setting of the interval between the respective resonance frequencies in the fundamental and higher modes can be easily performed. Furthermore, the range in which the interval between the respective resonance frequencies in the fundamental and higher modes can be adjusted can be increased. Accordingly, the interval between the respective resonance frequencies in the fundamental and higher modes can be accurately controlled to a predetermined interval.

Moreover, since the concavity or through-hole may be provided in the dielectric substrate, the circularly polarized wave antenna can be reduced in weight.

Referring to the communication device including the circularly polarized wave antenna having a characteristic constitution, the reliability of the antenna characteristic of the communication device can be enhanced, since the circularly polarized wave antenna having a high circularly polarized wave characteristic is mounted. Moreover, communication can be stably carried out, and the operation of the communication device can be stabilized. Furthermore, with the circularly polarized wave antenna being reduced in size, the communication device can be miniaturized.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A circularly polarized wave antenna comprising:

a substantially circular dielectric substrate;

a radiation electrode for transmitting and/or receiving a circularly polarized radio wave disposed on the upper face of the dielectric substrate;

a fundamental mode feed electrode for feeding power to the radiation electrode to excite the radiation electrode in a fundamental mode; and a higher mode feed electrode for feeding power to the radiation electrode to excite the radiation electrode in a higher mode;

wherein said fundamental and higher mode feed electrodes are formed on the side peripheral face of the dielectric substrate and configured so as to feed the power to the radiation electrode via capacitive coupling.

2. The circularly polarized wave antenna according to claim 1, wherein the radiation electrode is substantially circular, and is provided on the upper face of the dielectric substrate with the center of the radiation electrode being positioned substantially on the center axis of the dielectric substrate.

3. The circularly polarized wave antenna according to claim 1, wherein the radiation electrode has such a form as to carry out degeneracy-separation.

4. The circularly polarized wave antenna according to claim 1, wherein the radiation electrode is substantially a ring-shape, and is provided on the upper face of the dielectric substrate with a center of the ring of the radiation electrode being positioned substantially on the center axis of the dielectric substrate, and a non-electrode portion enclosed by the ring-shaped radiation electrode comprises a frequency setting portion for adjusting and setting an interval between respective resonance frequencies in the fundamental and higher modes.

5. The circularly polarized wave antenna according to claim 4, wherein a concavity or through-hole is formed in the non-electrode portion enclosed by the substantially ring-shaped radiation electrode, in the dielectric substrate.

6. The circularly polarized wave antenna according to claim 2, wherein the radiation electrode is polygonal in shape.

7. A communication device comprising at least one of a transmitter and a receiver and a circularly polarized wave antenna coupled to the at least one of a transmitter and a receiver, the circularly polarized wave antenna comprising: a substantially circular dielectric substrate;

a radiation electrode for transmitting and/or receiving a circularly polarized radio wave disposed on the upper face of the dielectric substrate;

a fundamental mode feed electrode for feeding power to the radiation electrode to excite the radiation electrode in a fundamental mode; and a higher mode feed electrode for feeding power to the radiation electrode to excite the radiation electrode in a higher mode;

wherein said fundamental and higher mode feed electrodes are formed on the side peripheral face of the dielectric substrate and configured so as to feed the power to the radiation electrode via capacitive coupling.

8. The circularly polarized wave antenna according to claim 1, wherein the radiation electrode is substantially circular, and is provided on the upper face of the dielectric substrate with the center of the radiation electrode being positioned substantially on the center axis of the dielectric substrate.

9. The circularly polarized wave antenna according to claim 1, wherein the radiation electrode has such a form as to carry out degeneracy-separation.

10. The circularly polarized wave antenna according to claim 1, wherein the radiation electrode is substantially a ring-shape, and is provided on the upper face of the dielectric substrate with a center of the ring of the radiation electrode being positioned substantially on the center axis of the dielectric substrate, and a non-electrode portion enclosed by the ring-shaped radiation electrode comprises a frequency setting portion for adjusting and setting an interval between respective resonance frequencies in the fundamental and higher modes.

11. The circularly polarized wave antenna according to claim 4, wherein a concavity or through-hole is formed in the non-electrode portion enclosed by the substantially ring-shaped radiation electrode, in the dielectric substrate.

12. The circularly polarized wave antenna according to claim 2, wherein the radiation electrode is polygonal in shape.

* * * * *